United States Patent [19]

Moosmüller

[11] Patent Number: 4,693,624

[45] Date of Patent: Sep. 15, 1987

[54] BINDING MECHANISM FOR PERFORATED PAPERS

[76] Inventor: Helmut Moosmüller, Martin Luther Str. 9, D-7733 Mönchweiler, Fed. Rep. of Germany

[21] Appl. No.: 753,666

[22] Filed: Jul. 10, 1985

[30] Foreign Application Priority Data

Jul. 13, 1984 [DE] Fed. Rep. of Germany ..... 3425827

[51] Int. Cl.[4] ..... B42F 13/10; B42F 13/02

[52] U.S. Cl. ..... 402/22; 402/8; 402/9; 402/6

[58] Field of Search ..... 402/5, 8, 19, 20, 21, 402/22, 60, 61, 63, 64, 68, 6, 9, 23; 24/31 L, 31 H, 71.2, 464, 623

[56] References Cited

U.S. PATENT DOCUMENTS

| | | | |
|---|---|---|---|
| 2,099,881 | 10/1935 | Emmer | 402/20 |
| 3,246,653 | 4/1966 | Sexton | 402/22 |
| 3,970,331 | 7/1976 | Giulie | 402/68 |

FOREIGN PATENT DOCUMENTS

| | | | |
|---|---|---|---|
| 1436185 | 10/1968 | Fed. Rep. of Germany . | |
| 7527298 | 11/1976 | Fed. Rep. of Germany . | |
| 817170 | 2/1937 | France | 402/19 |
| 2505262 | 11/1982 | France | 402/60 |

OTHER PUBLICATIONS

Published Abstract of GM 6914733, Heft 41, 10/9/1969, p. 2262.

Published Abstract of GM 7527298, GMA-Heft 11, 3/11/1976, p. 441.

Published Abstract of GM 7630776, GMA-Heft 4, 1/27/1977, p. 117.

*Primary Examiner*—Howard N. Goldberg

*Assistant Examiner*—Taylor J. Ross

*Attorney, Agent, or Firm*—McGlew and Tuttle

[57] ABSTRACT

A binding mechanism for the binding of perforated papers, has at least two elastically flexible tangs (5,6). These tangs (5,6) are arranged standing upright on the top side of a flat support strip (1). Their ends are releaseably connected with extension pieces (9,10). In order that the tangs (5,6) with their extension pieces (9,10) can be formed into ring arcs whose size is adaptable between a minimum and a maximum, to the bound paper stack height, the support strip (1) made of plastic has passages (7,8) into which the extension pieces (9,10) can be releaseably and lockingly inserted to different depths. The extension pieces (9,10) consist of separate, likewise flexible, rod or tongue like elements which have at least the same or a greater length than the tangs (5,6). The passages may be provided at their insertion-side ends with a detention edge or with a lock tooth, and the extension pieces with a lock tooth system.

15 Claims, 19 Drawing Figures

FIG. 1
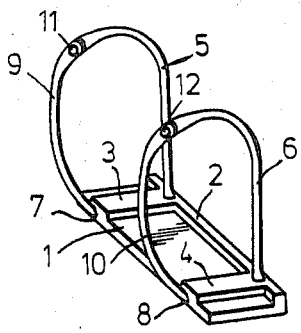
FIG. 2
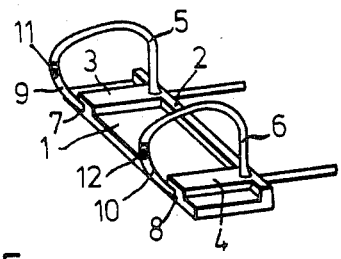
FIG. 5
FIG. 7
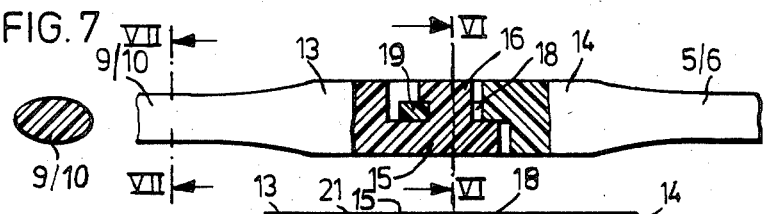
FIG. 6
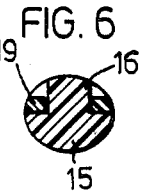
FIG. 8
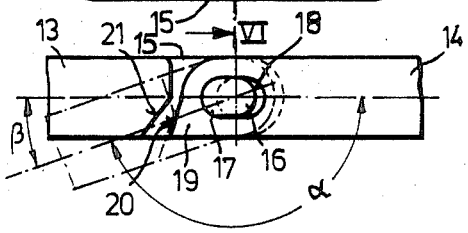
FIG. 9
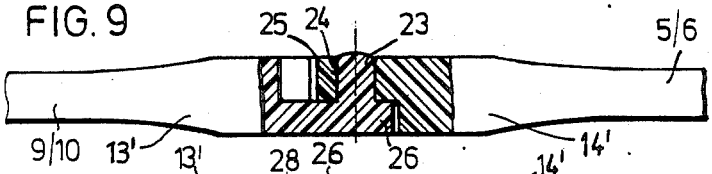
FIG. 10
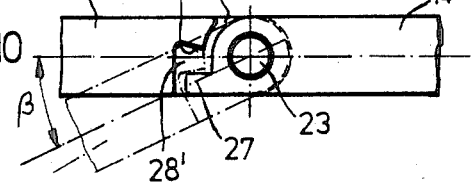

Fig. 3
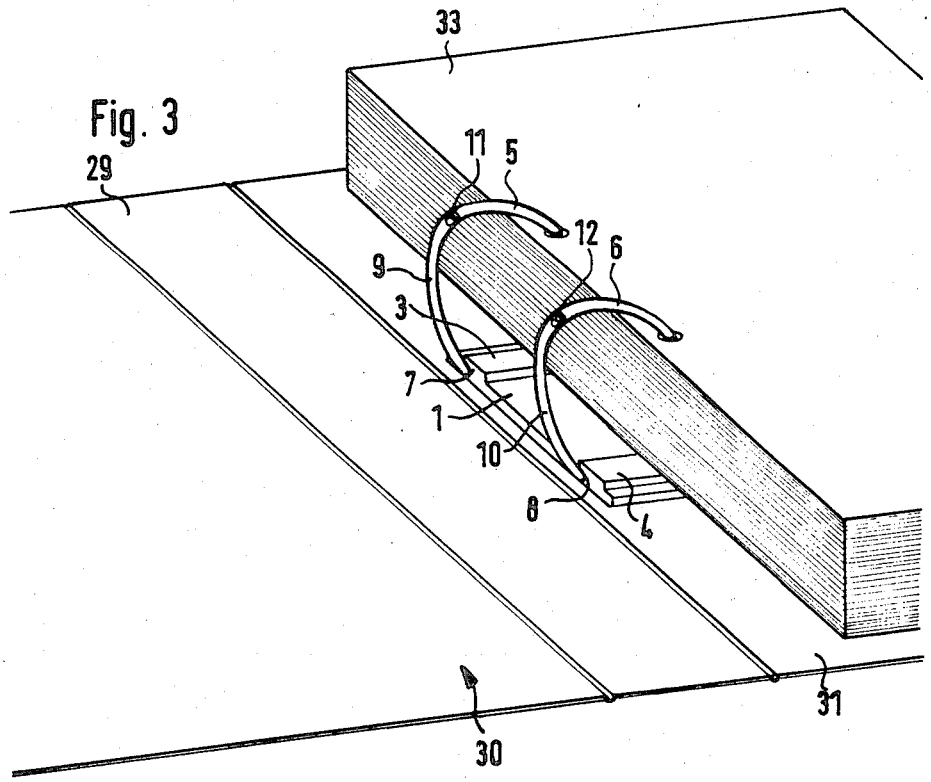
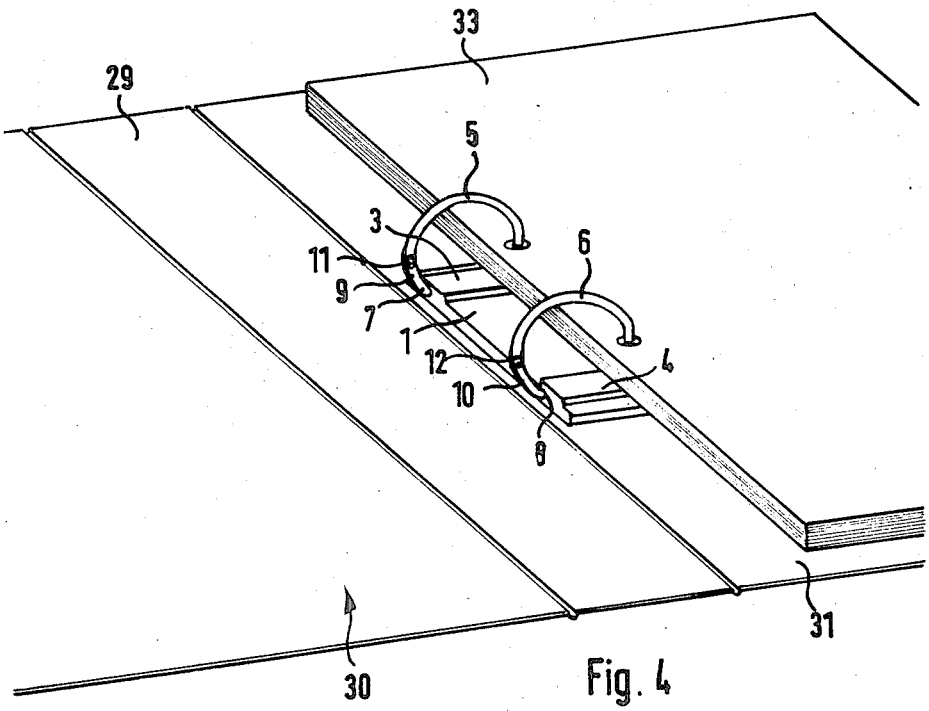
Fig. 4

BINDING MECHANISM FOR PERFORATED PAPERS

FIELD AND BACKGROUND OF THE INVENTION

The present invention relates in general to paper binders and in particular, to a new and useful binding mechanism for binding perforated papers having at least two elastically flexible tangs which are arranged on the top of a flat support strip of plastic in one piece and which are insertable in passages of the support strip for the formation of loop-like ring arcs of different sizes, which passages are arranged directly below the tangs and extending crosswise to the length of the support strip.

In a known binding device of the above-mentioned kind German GM No. 14 36 185, the elastically flexible tangs having a flat, ribbon-like cross-section are integrally formed in one piece with a plastic plate which together with three other plates of equal size forms the base part of the binding device. The tangs are arranged to protrude laterally at a longitudinal edge of the plate and insertable by their free ends into passages for the formation of ring arcs, the passages being arranged below the plate and machined into the plates located therebelow. So that the formed ring arcs cannot open by themselves, the tangs are provided with lock cams which can be introduced into bayonet grooves of a lock plate. These grooves are substantially perpendicular to the insertion direction of the passages. For taking out any sheets from the stack of bound sheets, or for adding new sheets, the ring arcs must be opened completely, that is, the tang ends inserted in the passages must be pulled out of the passages completely. This means that the portion of the stack which happens to be on top of the sheet that is to be removed, or on top of the place where a new sheet is to be inserted, must be taken off the tangs completely and must then be threaded on again. This complicates the handling of such binders. In addition, due to the locking by means of the lock cams at the individual tangs and because of the bayonet grooves, the adaptation of the size of the ring arcs formed to the thickness of the stack of sheets can, at best, take place in large gradations.

In the binder of British Pat. No. 968,650, two separate base plates are fastened side by side on the inside of the binder cover. They may be provided with integrally formed or separate tangs. The tangs of one base plate are inserted into crosswise extending openings of the other base plate to form loops. In this way it is indeed possible to open the rings formed by pairs of tangs with the stack divided. But rethreading is cumbersome because the passages of the opposite base plate are concealed by the stack portions lying thereon and because the tangs must be bent at right angles for insertion in the passages.

In another known binding mechanism German GM No. 75 27 298, elastically bending tangs are provided which can be fastened by one end at a paper carrier, while the other ends are detachably connectable with extension pieces which are arranged laterally in one piece at a so-called cover strip by which the papers are held together as in a stack. For connecting the tangs with the extension pieces of the cover strip, the free ends of the tangs are tubular and the extension pieces are provided at their ends with conical pins which can be fitted into the tubular ends of the tangs. It may be provided also that the tangs are made in the form of an elastic plastic hose or a flexible, wound metal spring. The cover strip has the form of a flat band with laterally open conical slits which can receive the tangs and clamp them. The extension pieces consist of non-flexible cylindrical pins. For the papers to be threaded on the tangs, the tangs must be separated from the extension pieces, and also the support strip must be removed from the tangs. The length of the extension pieces is chosen so that it is approximately as great as or somewhat greater than the thickness of the maximum amount of papers to be bound, in order that they can receive a bound papers stack normally threaded on the tangs. For transferring the paper stack from the tangs to the extension pieces, the tang ends are connected with the extension pieces and the cover strip is detached from the tangs. In any event, the extension pieces are substantially shorter than the tangs themselves, whose length must be greater by a multiple, than the maximum stack height of the papers to be bound, because otherwise bends that might cause breakage of the tangs are inevitable if, with the cover strip clamped on the stack of the tangs, the ends of the tangs are to be connected with the extension pieces extending downwardly parallel to the surface of the stack or even with the back of the stack, in order that their end sections exceeding the stack height, will not hang over freely. When the threaded paper stack is transferred wholly or partially onto the extension pieces and the tangs must be separated from the extension pieces for the purpose of placing in or taking out one or more sheets, the cover strip with its extension pieces no longer has any connection with the paper carrier. As a rule, the cover strip then stands on its narrow lengthwise edge opposite the extension pieces, so that it may easily tip over and consequently some sheets may become detached from the stack portion threaded on the extension pieces, or it may not readily be possible to prevent this.

When, to secure the threaded paper stack, the cover strip is clamped fast to the tangs and the free ends of the tangs are connected with the extension pieces, these free ends of the tangs form loops of a size depending on the stack thickness which lie completely over the stack plane. If these loops are not to be in the way, for example when closing a file in which this binding mechanism is employed, it must be possible to tip them over to the side, for which reason the tangs must have a high flexibility but be little resilient, because a file cover resting on the tipped tang loops would be flapped open by the loops standing up again. High flexibility however, and low resilience or low stiffness of the tangs means at the same time, instability of the tangs, so that, in particular in the case of hanging files, the tangs tend to assume an oblique position, making it difficult to turn the pages or the entire stack, as they cannot firmly guide the sheets to be turned in their perforations.

To avoid that the cover strip, when it is clamped on the tangs, will easily slide along them, the tangs are provided with a sawtooth or sinuous surface. An uneven surface of the tangs, however, means reduced ease in threading as well as removal or turning over of the individual sheets on the tangs. There is also a great danger that the holes of the paper will tear.

In another threading device German GM Nos. 76 30 776 and 69 14 733, which is intended for quick binders, letter files and the like, two rigid threading pins and two movable bows are arranged on an attachment plate, the ends of the pins and bows facing each other being adapted to be detachably connected together by means of matched detent and counter-detent elements. The bows consist of elastic material, and they are made in teh form determined by the desired open position, so that they can be connected with the rigid threading pins by deformation overcoming their inherent elasticity. The bows may be made as separate parts and provided at both ends with detent/counter-detent elements, and in addition to the threading pins rigid connecting pins may be arranged, at whose ends the bows are lockable. With this threading device the space requirement is constant independently of the thickness of the bound paper stack, as the length of the threading pins and of the elastic bows is invariable. When the bow ends are locked with the threading pins and with the attachment plate or the connecting pins thereof, the bow height is always the same.

SUMMARY OF THE INVENTION

It is the object of the present invention to improve a binding mechanism of the initially mentioned kind, where the tangs can form ring arcs whose size is adaptable between a minimum and a maximum to the respective paper stack thickness to be bound, in such a way that the ring arcs formed by the tangs are adaptable at least nearly continuously to the sheet stack thickness and can at any time be opened in a simple manner, even with the paper stack transferred wholly or partly from the binder back to the binder cover side, without need to detach a part, in particular the part of the stack lying on the binder cover side, from the tangs, and where the ring arcs are to be readily widenable to a measure which permits easy opening and closing of the ring arcs.

According to the invention, the problem is solved by the fact that the tangs are made in two parts and consist each of a section integrally formed upright on the support strip top side and of an extension piece connected therewith mechanically locking (but being releaseable) the extension pieces consisting also of elastically bending, rod or tongue like elements which are as long as or longer than the tang sections which are integrally formed directly on the support strip. The extension pieces are lockable against axial displacement at the insertion-side ends of the passages in the strip by means of releasable fixing means acting by force or mechanically.

Besides the advantages resulting from usage of the invention, the binding mechanism thus defined has the merit that for turning the sheets, for turning the paper stack ove, or for the binding of new document sheets on the already existing stack, the ring arcs thus formed by the tangs and their extension pieces can be enlarged from a minimum size adapted to the paper stack thickness to an appropriate measure again, in that the sections of the extension pieces inserted in the passages are pulled out again at least partially. In the case of a large ring it is also easier to open and to reclose the connections between the extension pieces and the tangs, and also it can be assured that the extension piece sections receiving the transferred paper stack or portion of the paper stack are long enough to protrude from this transferred portion of the paper stack so that the topmost sheets will not be themselves become detached.

Not only can it be assured that the extension piece sections inserted in the passages will, without the action of external influences, remain in the position in which they have been brought before the respective binder, file or the like was closed, but also it is possible to lift the binding mechanism by one or both rings without danger that the extension pieces slip out of the passages and the entire device falls out of the person's hand.

According to two features of the invention, the passages at their insertion ends are provided with either an engaging edge or a downwardly directed locking tooth. These have the advantage that they assure, in a very simple but effective manner, a partially dynamic but predominantly mechanical stable connection between the extension pieces and the support part and moreover can readily be realized by injection molding.

To allow the lock tooth, thus provided to have as a conventional cooperative element at the extension pieces, a serration which is not in the way when threading or turning over sheets or rearranging the stack, the extension pieces are preferably formed to have countersunk in their surface locking teeth extending in a longitudinal direction of the extension piece.

According to another feature of the invention the passages at their insert end have elastically flexible supporting tongues directed upwardly and offset toward an outside of the passages for pressing the extension pieces up into the engaging edge or locking tooth. The advantage is thus obtained, on the one hand, that the extension pieces manually inserted into the passages remain more securely in engagement in the detent or locking devices arranged at the insertion-side ends of the passages, and that the tendency of the extension piece ends connected with the tangs to become detached from the tangs is at least largely counteracted, with the result that the extension piece sections protruding from the passages, detached from the tangs, assume an upwardly directed oblique position and that thus papers threaded on these detached extension piece sections are held more securely.

Another clamping means which is very easy to realize and to handle for the releasable fixing of the extension pieces inserted in the passages utilizes clamping ribs at the insertion side of the passages extending toward each other in wedge form which reduced, by one-half, the insertion opening and between which the extension pieces can be clamped.

A still further feature of the invention provides for the tangs and extension pieces to have an elliptical cross-section with a short axis of the ellipse lying in a plane transverse to the length of the strip. Due to elliptical cross-section, the flexibility of the tangs as well as of the extension pieces in the desired bending direction is much greater than the flexibility in the direction of the long axis of the cross-section ellipse and that thereby also a higher form stability of the two tangs and extension pieces formed into rings is obtained, which too contributes to easier handling especially with respect to turning the pages.

According to a still further feature of the invention, the ends of the tangs and extension pieces include abutment surfaces to limit the pivotable freedom between the ends of the tangs and extension pieces to a maximum angle of about 45°. This results in different bending forms between the tangs and the extension pieces in such a way that the radius of curvature of the extension pieces is always greater than the radius of curvature of the tangs, and that the tangs exert on the extension pieces connected with them and inserted in the passages a tensile force which contributes to stabilizing the engagement or clamping between the extension pieces and the engagement means of the passages on the insertion side. This brings about a stronger bend of the extension pieces and hence an improved mechanical locking in this region. It is immaterial in principle whether the different rigidity is achieved by choice of material or by different cross-section forms.

These features of the invention result, on the one hand, in couplings between the tangs and the extension pieces which are easy to handle, i.e. to release and to connect with one another, and which yet are stable in the connected state, and on the other hand it is assured that the tangs and extension pieces can form at their points of connection not too small an angle with one another which could be a hindrance when turning the pages or when transferring the paper stack from one side to the other.

A still further object of the invention is thus to provide a binding which is simple in design rugged in construction and economical to manufacture.

The various features of novelty which characterize the invention are pointed out with particularity in the claims annexed to and forming a part of the disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a perspective view of a binder mechanism of the invention;

FIG. 2 is a view similar to FIG. 1 showing the same binding mechanism, but with tang rings set smaller;

FIG. 3 is a perspective view of the binding mechanism of FIG. 1 in an opened file and with a thick stack of papers;

FIG. 4 is a view similar to FIG. 3 of the binding mechanism of FIG. 2 in a file, set to a smaller stack of papers;

FIG. 5 is a sectional view of a twist coupling by which the tangs and extension pieces can be releasably joined together;

FIG. 6 is a view taken along line VI—VI of FIG. 5;

FIG. 7 is a view tkane along line VII—VII of FIG. 5;

FIG. 8 is a top plan view of FIG. 5;

FIG. 9 is a sectional view of a snap button type coupling for connecting the tangs with the extension pieces;

FIG. 10 is a top plan view of FIG. 9;

DESCRIPTION OF THE PREFERRED EMBODIMENTS

Figure 14:
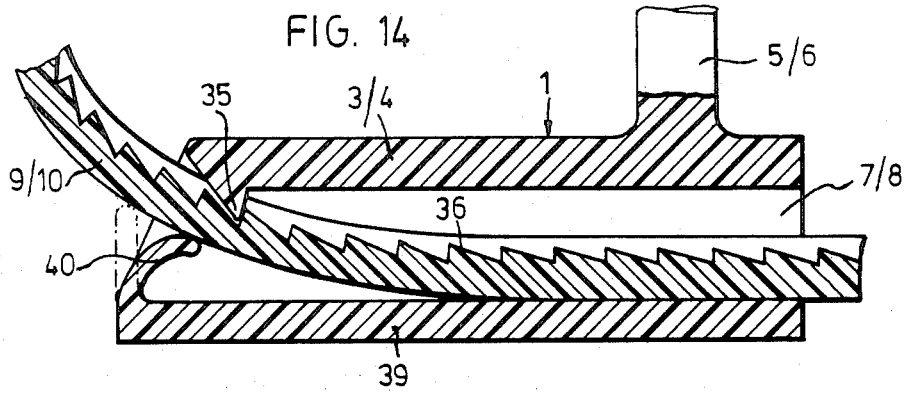
FIG. 14 is a sectional view of another form of a passage with inserted and locked extension piece.

In all forms of the invention shown in the drawing, the binding mechanism consists of a flat, oblong support strip 1 which is made of plastic and has along its one longitudinal edge on the top side a thickening rib 2 as well as two transversal thickening ribs 3 and 4. The center distance of the thickening ribs 3 and 4 corresponds to the standard distance between holes of perforated paper and thus is 80 mm. On these thickening ribs 3 and 4, near the longitudinal thickening rib, tangs 5 and 6 are integrally formed as one piece with strip 1 and extend perpendicularly upright from the top side of the strip. These tangs come out of the injection mold as straight rod-shaped elements and are connected at their ends with coupling elements to be explained more specifically below with reference to FIGS. 5 to 11. Thus, together with the two tangs 5 and 6 the support strip 1 forms a one-piece injection molding. In the thickening ribs 3 and 4, which extend crosswise to the longitudinal direction of support strip 1, there are arranged under the tangs 5 and 6 passages 7 and 8 which extend crosswise to the longitudinal direction of support strip 1 and which serve to receive extension pieces 9 and 10 which are connectable or are connected with the free ends of the tangs 5 and 6. The tangs 5 and 6 as well as the extension pieces 9 and 10 have an ellipsoid cross-section, as illustrated in FIG. 7, the short axis of the ellipse extending crosswise to the longitudinal direction of support strip 1. The result of this cross-section form in particular of the tangs 5 and 6 is that in the median plane extending crosswise to the longitudinal direction os support strip 1 they have a much greater bending elasticity than in the plane extending in the longitudinal direction of the support strip 1 in which the long axis of the elliptical cross-section profile lies. The same applies also to the extension pieces 9 and 10 when they are connected with the tangs 5 and 6 by couplings 11 and 12 to be explained below. The coupling elements of the couplings 11 and 12 are each integrally formed at the thickened end sections 13,14 of the tangs 5 and 6 or respectively of the extension pieces 9 and 10, the cross-sectional form fo which, likewise elliptical but thicker in the direction of the short axis of the ellipse, can be seen from FIG. 6. In the embodiment of FIGS. 5, 6 and 8 there is integrally formed at a tongue 15, which is flatted to half the cross-section of the end section 13 of the extension piece 9,10, a latch pin 16 having a latch nose 17. This forms first locking means. A tongue 19 serves as counter-piece, with a slot 18 also flattened to half the cross-section, which is integrally formed at the end section 14 of the tangs 5 and 6, respectively. The basic form of pin 16 is cylindrical, and therefore it can rotate in slot 18. In order that the end sections 13 and 14 joined together in the manner illustrated in FIG. 5, which because of their thickening are more rigid than the other sections both of the tangs 5 and 6 and of the extension pieces 9 and 10, cannot rotate about the axis of the lock pin 16 so far that they can form too small an angle $\alpha$ with one another (which could be a hindrance when turning the pages or in transferring a bound paper stack) the tank 19 is provided with an oblique blocking surface 20, which abuts on a likewise oblique abutment surface 21 of the end section 13 when the two sections 13 and 14 are rotated out of their aligned position about the axis of latch pin 16 by the angle $\beta$. For engaging and disengaging this coupling it is necessary that the two end sections 13 and 14 assume the aligned position shown in top view in FIG. 8. By appropriate shifting, the latch nose 17 can then be released from tongue 19 and the latch pin 16 can be taken out of the slot 18 by transverse displacement or, when establishing the connection, be inserted into slot 18. By the ring formation which results when the free ends of the extension pieces 9 and 10 are inserted into the passages 7 and 8, there results the mutual rotation of the two end sections 13 and 14 in the manner shown in dash-dot lines in FIG. 8. Hence, also the latch nose 17 assumes an oblique position relative to the axis of slot 18, so that automatic release in this position is not possible. The angle $\beta$ should not be greater than 45°.

Figure 11:
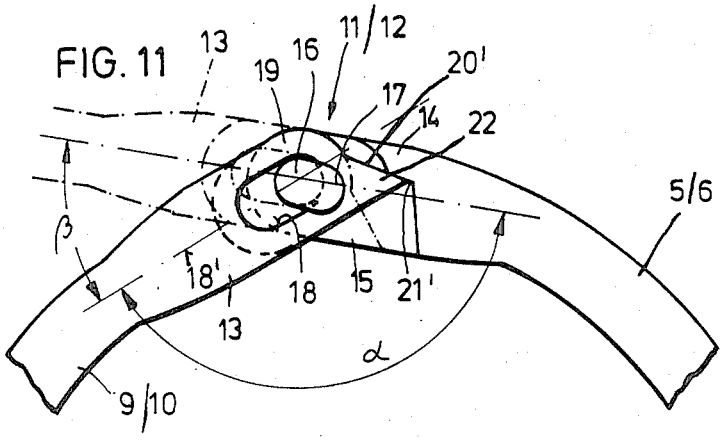
FIG. 11 is a top plan view of another form of the coupling similar to those of FIGS. 5 and 8.

In the form of the couplings 11/12 shown in FIG. 11, the end section 13 of the extension piece 9,10 is provided with the flattened tongue 19 that has the slot 18, and the end section 14 of tange 5,6 has the flattened tongue 15 with the latch pin 16 and its latch nose 17. The maximum angle of rotation $\beta$, which is about 40° to 45° and thus permits a minimum angle of inclination $\alpha$ between the two end sections 13 and 14 of 140° to 135°, is determined by a blocking surface 20′ of a triangular projection 22 of tongue 19 and by an abutment surface 21′ of the end section 14.

It can be seen from FIG. 11 also that in this angle position of the two end sections 13 and 14 the latch tongue 17 stands obliquely to the axis 18′ of the slot 8 in the manner of a twist coupling and ensures in this position of the two end sections 13 and 14 the unreleaseability of the connection.

In FIGS. 9 and 10, the coupling 11,12 between the end sections 13′ and 14′ of the extension pieces 9/10 or respectively of the tangs 5/6, which are thickened in the same manner as in the embodiment of FIGS. 7, 8 and 11, consists of a snap button like lock pin 23 which snaps into a cylindrical bore 24 of a tongue 25 flattened to half the cross-section and is integrally formed at the tongue 26 flattened to half the cross-section. Tongue 25 has a projection 27 which abuts against a blocking surface 28 of the end section 13′ when the latter moves into a pivoted position indicated in dash-dot lines in FIG. 10 relative to the end section 14. By the projection 27 and the abutment surface 28 the maximum pivot angle $\beta$ is determined. For this form of the coupling it is not absolutely necessary that the two end sections 13′ and 14′ assume an exactly aligned position when being connected or released. All that is necessary is that their rotation relative to the axis of pin 23 lies within the angle $\beta$, so that the projection 27 can get into the cutout 28′ of end section 13′ which is limited by the abutment surface 28.

FIGS. 3 and 4 illustrate how the support strip 1 with its tangs 5 and 6 and with the extension pieces 9 and 10 is fastened next to the center part 29 forming the back of a binder or file 30 on the inside of the rear cover 31, for example by gluing, and how the tangs 5 and 6 together with the extension pieces 9 and 10 form rings of different size, which are adapted to the respective thickness of a bound paper stack 33 in that the extension pieces 9 and 10 are inserted more or less far into the passages 7 and 8 of the support strip 1.

Figure 12:
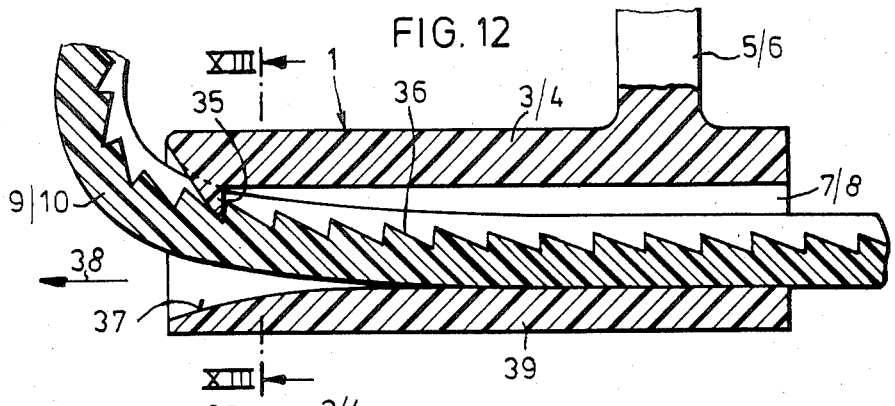
FIG. 12 is a sectional view on a larger scale, taken through a passage provided with a lock tooth, with the extension piece inserted.
Figure 13:
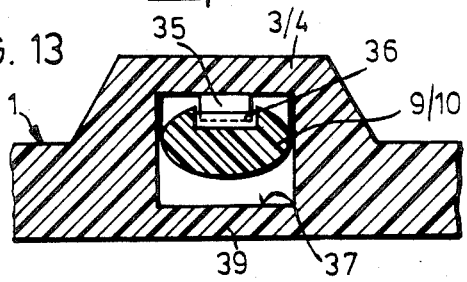
FIG. 13 is a view taken along line XIII—XIII of FIG. 12.

So that the extension pieces 9 and 10 cannot by themselves slip out of the passages 7 and 8, or respectively so that the extension pieces 9 and 10 will not be pulled out of the passages 7 and 8 unintentionally even when for example the entire binder or file 30 is lifted by gripping the two rings formed by the tangs 5 and 6 and the extension pieces 9 and 10, clamping devices are provided at the insertion-side ends of the passages 7 and 8, which will be explained more specifically below with reference to FIGS. 12 to 19. In the embodiment of FIGS. 12 and 13, the insertion-side ends of the passages 7 and 8 are provided on their top side with a downwardly protruding lock tooth 35, and the extension pieces 9 and 10 with a lock tooth system 36, extending from the end sections 13 over the entire length, which is countersunk in their generated surface and which is held in engagement with the lock tooth 35 for example by the rigidity of the extension pieces 9 and 10 or by other means still to be described more specifically below with reference to FIGS. 14 and 15. This forms second locking means.

From FIG. 12 it can be seen that the passages 7,8 are open on both sides. From FIG. 13 it can be seen that the width of the passages 7,8 is only slightly greater than the width, i.e. the long axis, of the cross-section ellipse of the extension pieces 9,10, and that the lock tooth 35, whose width is approximately one third the width of the passage 9,10, is arranged at the upper horizontal transverse edge in the center thereof, and that the lock tooth system 36 countersunk in the surface of the extension pieces 9,10 is arranged on the inner flat side of the cross section. By the countersunk arrangement of the lock tooth system 36 it is assured that it is not a hindrance when turning pages or inserting the papers and that also there is no danger that by this tooth system the perforated edges of the papers could be damaged. The countersunk tooth system 36, which is easy to produce by injection molding, leads moreover to increased flexibility of the extension pieces 9 and 10 as compared with the tangs 5 and 6 having the same elliptical cross section.

For the lock tooth system 36 to be releasable from its engagement with lock tooth 35, the insertion-side end section 37 of the bottom 39 of the passage 7,8 is widened downwardly in trumpet or conical form, so that it is possible to push the extension piece 9,10 down and at the same time to pull it out of the passage 7,8 in the direction of arrow 38.

Figure 15:
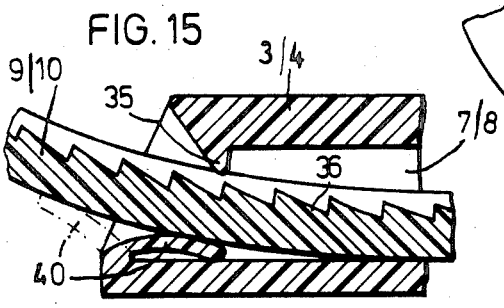
FIG. 15 is a partial section from FIG. 14 showing the unlocked position of the extension piece.

In the form of realization of FIGS. 14 and 15, there is arranged on the bottom 39 of the passage 7,8 an upwardly directed supporting tongue 40 offset to the outside relative to lock tooth 35, which supporting tongue holds the tooth system 36 of the extension piece 9,10 in engagement with the lock tooth 35 also when the extension piece 9,10 is not connected with a tang 5,6, that is, when coupling 11, 12 is released. The cross-section form of the supporting tongue 40 is chosen so that the supporting tongue can be bent both in the position shown in solid lines in FIG. 15 and in the position shown in dash-dot lines if by pressing the extension piece 9,10 down, its lock tooth system 36 is to be released from the lock tooth 35. But this supporting tongue 40 not only has the advantage that it holds the lock tooth system 36 in engagement with the lock tooth 35, it brings about also that the section of the extension piece 9,10 protruding on the insertion side from the passage 7,8 and released from the tang 5,6 remains directed upward at least in oblique position and cannot move into its horizontal extended position. The supporting effect is important especially when document material is placed on the sections of the extension pieces 9,10 detached from the tangs 5,6, because by this support of the extension pieces 9,10 and by their holding in upwardly directed oblique position the danger that papers will become detached from the extension pieces is greatly reduced.

Figure 16:
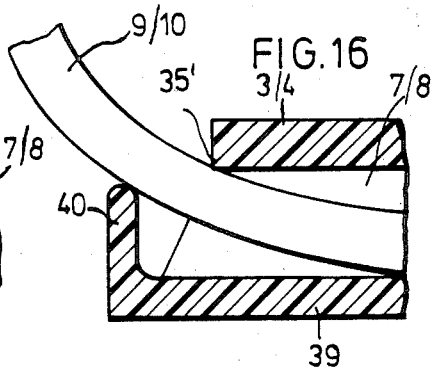
FIG. 16 is a section through the insertion-side opening of another passage with an extension piece having a smooth outer surface.

In FIG. 16, a simplified form of a clamping device is illustrated where instead of the lock tooth 35 merely a sharp upper end edge 35' is provided at the insertion-side end of the passage 7,8, and the extension pieces 9,10 are provided, not with a lock tooth system 36, but with a smooth surface as shown in FIG. 7. However, the supporting tongue 40 is present in the same manner and for the same purpose as in the embodiment of FIGS. 14 and 15. The support strip 1 with its tangs 5, 6 may be provided to consist of a harder plastic than the extension pieces 9,10, so that the end edge 35' as locking element can penetrate more effectively in notch fashion into the surface of the extension piece 9,10 and can act like a lock tooth.

Figure 17:
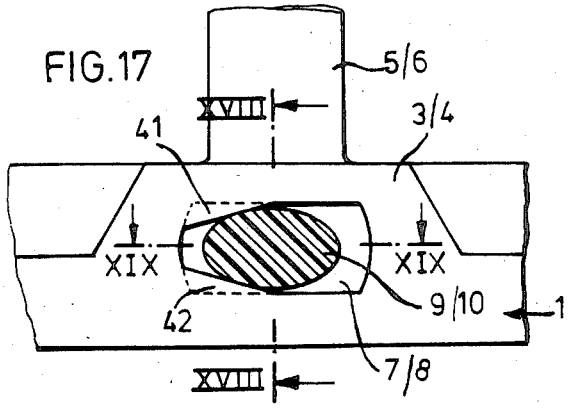
FIG. 17 is a front view of a passage on the insertion-side, provided with conical clamping ribs.
Figure 18:
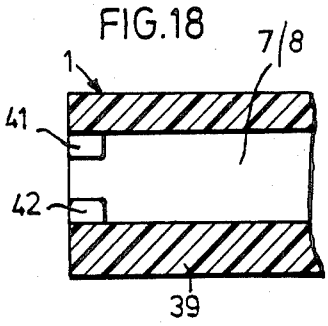
FIG. 18 is a view taken along line XVIII—XVIII of FIG. 17.
Figure 19:
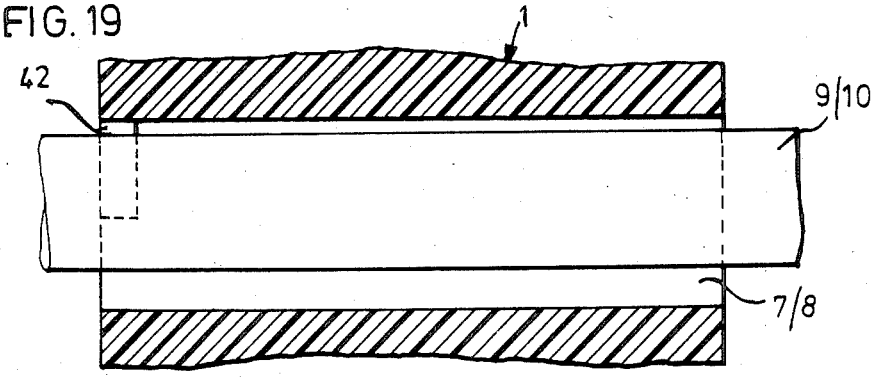
FIG. 19 is a view taken along line XIX—XIX of FIG. 18.

In the embodiment of FIGS. 17 to 19, the extension pieces 9 and 10 also have an elliptical cross-section with smooth surface. The passages 7,8 are made a little wider than the extension pieces 9,10. At their insertion-side ends the passages 7,8 have conical or converging clamping ribs 41 and 42 over half the side. Between them the extension pieces 9,10 can be releasably clamped, as can readily be seen from FIG. 17.

It has been mentioned above that by providing a countersunk lock tooth system 36 at the extension pieces 9,10 a higher flexibility as compared with the tangs or tang sections, having the same elliptical cross section, is obtained. This higher flexibility of the extension pieces relative to the tangs, which can be achieved also by other cross-section forms or by an appropriate choice of material, has the advantage that, with the ring formation upon introduction of the free tang ends into the passages 7 and 8, the tangs 5 and 6 are curved more than the extension pieces 9 and 10 thereafter subjected to ensile stress. This, however, occurs at the expense of a stronger bend of the extension pieces 9 and 10 in the region of the insertion-side ends of the passages 7,8, but this is not a disadvantage. On the contrary it results in a higher stability of the clamping union.

In this connection it is important also that the extension pieces 9 and 10 are at least of the same length as the tangs 5 and 6. Preferably, however, they are longer than the tangs 5 and 6, because only then is it possible to utilize the entire length of the tangs 5 and 6 as stack height and to make the rings formed by the tangs 5,6 and the extension pieces 9,10 so large, for the purpose of turning pages or rearranging a bound paper stack, that this work can be carried out smoothly. Also for releasing and connecting the couplings 11 and 12 the formation of large rings is advantageous.

Whether the extension pieces 9,10 are pulled out of the passages for the threading of papers or are separated from the tangs by releasing the couplings 11, 12 is up to the user.

While specific embodiments of the invention have been shown and described in detail to illustrate the application of the principles of the invention, it will be understood that the invention may be embodied otherwise without departing from such principles.

What is claimed is:

1. A binding mechanism for perforated papers comprising, a flat support strip of plastic having a long dimension and a short dimension for supporting a stack of perforated paper, at least two elastically flexible tangs partly integrally formed as one piece with and on top of said flat support strip, said tangs being spaced along the long dimension and being insertable in passages of the support strip for the formation of loop-like ring arcs of different size, which passages are arranged directly below the tangs and extend across the short dimension of the support strip, the tangs being made in two parts, the tangs each comprising a tang section which is integrally formed perpendicular upright on the support strip top side at one side of said strip and an extension piece connected with the tang section and mechanically releasably locked to the tang section, said extension pieces being lockable against axial displacement at insertion-side ends of the passages by releasable fixing means, said insertion-side ends being on an opposite side of said strip from said upright tang sections, the passages being provided at their insertion-side ends with an engaging edge for engaging one of the extension pieces, the extension pieces having counter sunk in their surfaces a locked tooth system extending in a longitudinal direction thereof, the passages having at their insertion-side end an elastically flexible supporting tongue directed from a bottom thereof upwardly and offset toward and outside of the passage relative to the engaging edge.

2. A binding mechanism for perforated papers comprising, a flat support strip of plastic having a long dimension and a short dimension for supporting a stack of perforated paper, at least two elastically flexible tangs partly integrally formed as one piece with and on top of said flat support strip, said tangs being spaced along the long dimension of said support strip and being insertable in passages of the support strip for the formation of loop-like ring arcs of different size, which passages are arranged directly below the tangs and extend across the short dimension of the support strip, the tangs being made in two parts, the tangs each comprising a tang section which is integrally formed perpendicularly upright on the support strip top side at one side of said strip, and an extension piece connected with the tang section and mechanically releasably locked to the tang section, said extension pieces being lockable against longitudinal displacement at insertion-side ends of the passages by releasable fixing means, said insertion-side ends being on an opposite side of said strip from said upright tang sections; first locking means interconnecting each said tang section with its associated extension piece, said first locking means comprising an opening in one of said tang section or said associated extension piece, and a pin in the other of said tang section or said associated extension piece engaged in said opening, said opening and said pin extending transversely to the longitudinal direction of said tang section and said associated extension piece; said releasable fixing means comprising a locking element at said insertion-side end of said passage engaging said extension piece for substantially continuous adjustment of the length of said extension piece extending into said passage.

3. A binding mechanism according to claim 2, wherein the passages are each provided at said insertion-side ends with clamping ribs extending toward each other in wedge form which reduce one half of the passage opening and between which the extension pieces are clampable to form said fixing means.

4. A binding mechanism according to claim 2, wherein the tang sections and the extension pieces have an elliptical cross-section, the short axis of the ellipse lying in a given plane extending perpendicular to the long dimension of the support strip.

5. A binder according to claim 1, wherein said second locking means comprising a tooth connected to said strip extending downwardly into each said passage at said insertion-side end thereof, each said extension piece having an outer surface with recessed tooth means therein comprising a plurality of teeth, one of which is engageable with said tooth of said strip for locking said extension piece in said passage.

6. A binder according to claim 5, wherein said passage has a lower end which outward extends beyond said insertion-side end, said second locking means further comprising a flexible tongue extending upwardly from the lower end of said passage into said insertion-side end and into engagement with said extension piece for holding said one tooth of said extension piece into engagement with said tooth of said strip.

7. A binder according to claim 2, wherein said tangs and said extension pieces have a cross-section in a plane parallel to said longitudinal direction which is elliptical with a short axis of said elliptical cross-section being transverse to said longitudinal direction at a long axis of said elliptical cross-section being parallel to said longitudinal axis, said first locking means comprising said end sections of said tangs and extension pieces comprising enlargements in cross-section of said tangs and extension pieces respectively, one of said end sections having a hole therein and the other of said end sections having a pin extending into said hole for releasably locking said end sections together.

8. A flat support strip having a top surface for supporting a stack of perforated sheets and a longitudinal direction with at least two passages in said flat strip extending transversely to said longitudinal direction, said strip being connected on a rear cover;

at least two elastically flexible tangs connected as one piece to said flat support strip and extending perpendicularly upward from said top surface of said flat support strip on one side thereof, said tangs each having an end section spaced away from said strip;

at least two extension pieces having a first end extending into an open end of a respective one of said passages, and an opposite end with an end section, said open ends of said passages being on the opposite side of said strip from said tangs;

first locking means integrally formed as one piece with said end sections of said extension pieces and said tangs for releasably locking said end sections together for form a loop for engaging perforations of the stack of perforated sheets; and second locking means formed as one piece with said first ends of said extension pieces and said passages of said strip for releasably locking said first ends of said extension pieces in said passages;

said tangs and said extension pieces having a cross-section in a plane perpendicular to their longitudinal direction which is elliptical with a short axis of said elliptical cross-section lying in a plane which is transverse to said longitudinal direction of said strip, and a long axis of said elliptical cross-section being parallel to said longitudinal direction of said strip, said first locking means comprising said end sections of said tangs and extension pieces comprising enlargements in cross-section of said tangs and extension pieces respectively, one of said end sections having a hole therein and the other of said end sections having a pin extending into said hole for releasably locking said end sections together;

said second locking means comprising said passage open end having an edge at a top of said open end for engaging said extension piece, and a tongue extending upwardly from said strip into an area in front of said open end and into engagement with said extension piece for pressing said extension piece into said edge.

9. A binder according to claim 8, wherein said hole comprises an elongated slot, said pin having a radially extending nose for holding said pin in said slot.

10. A binder according to claim 9, wherein said end pieces include abutment surfaces for limiting an amount of pivoting between said end sections on an axis of said pin.

11. A binder according to claim 8, wherein said pin has an enlarged end and said hole is shaped to receive said pin in snap-lock fashion for retaining said pin in said opening.

12. A binder according to claim 11, wherein said end pieces include abutment surfaces for limiting an amount of pivoting between said end sections on an axis of said pin.

13. A binding mechanism according to claim 8, wherein the tang sections are more rigid than the extension pieces.

14. A binding mechanism according to claim 13, wherein free end sections of the tang sections and the end sections of the extension pieces to be attached thereon have a cross-section which is thickened relative to the short axis of the cross-section ellipse and are flattened in tongue form in the direction of the long axis of the cross-section ellipse, and that the flattened end sections of one of the tang sections or the extension pieces have said opening and the flattened end sections of the other of the extension pieces or the tang sections have said pin mechanically hooked in the opening.

15. A binding mechanism according to claim 14, wherein the flattened end sections of the tang sections and of the extension pieces are provided with abutment surfaces and blocking surfaces arranged eccentrically to the longitudinal axis of said pin which limit the relative pivotability of the joined end sections of the tang sections and of the extension pieces in such a way that the extension pieces are inclinable out of a coaxial position relative to the tang sections by a maximum angle of 45°.

* * * * *